United States Patent [19]

Fiedler et al.

[11] Patent Number: 4,541,679

[45] Date of Patent: Sep. 17, 1985

[54] ELECTRICAL CONNECTOR STRIP

[75] Inventors: Karl E. Fiedler, Korntal; Helmut Fuchs, Halver, both of, Fed. Rep. of Germany

[73] Assignee: Karl Lumberg GmbH & Co., Schalksmuhle, Fed. Rep. of Germany

[21] Appl. No.: 513,216

[22] Filed: Jul. 13, 1983

[30] Foreign Application Priority Data

Jul. 13, 1982 [DE] Fed. Rep. of Germany ..... 3226128

[51] Int. Cl.[4] ..... H01R 9/08

[52] U.S. Cl. ..... 339/97 P; 339/274

[58] Field of Search ..... 339/95 R, 95 D, 97 R, 339/97 P, 98, 99 R, 274

[56] References Cited

U.S. PATENT DOCUMENTS

| | | | |
|---|---|---|---|
| 2,738,479 | 3/1956 | Gibson . | |
| 4,341,430 | 7/1982 | Crawford | 339/99 R |
| 4,379,605 | 4/1983 | Hoffman | 339/97 P |
| 4,426,125 | 1/1984 | Crawford | 339/99 R |

FOREIGN PATENT DOCUMENTS

| | | |
|---|---|---|
| 2355873 | 5/1974 | Fed. Rep. of Germany . |
| 2915184 | 10/1979 | Fed. Rep. of Germany . |
| 2902536 | 4/1980 | Fed. Rep. of Germany . |
| 2207369 | 6/1974 | France . |
| 2423885 | 11/1979 | France . |
| 2019126 | 10/1979 | United Kingdom . |

*Primary Examiner*—Joseph H. McGlynn

*Attorney, Agent, or Firm*—Karl F. Ross; Herbert Dubno

[57] ABSTRACT

A connector strip comprises a row of swivel members each of which has a swivel portion held on a housing by a contact band provided with a keyhole window through which a conductor can be inserted through a guide passage into a hole within the pivot portion so that rotation of the swivel member entrains the conductor into the cutting slot of the window to make electrical contact and to mechanically enter the conductor to the contact.

20 Claims, 5 Drawing Figures

ELECTRICAL CONNECTOR STRIP

FIELD OF THE INVENTION

Our present invention relates to an electrical connector strip, and more particularly, to a connector strip of the type in which a conductor is electrically connected to a contact member and, by movement of a movable part of the strip, the conductor is not only locked into electrical connection with the contact member, but also is mechanically secured against withdrawal.

BACKGROUND OF THE INVENTION

Various connecting strips or connecting devices have been provided heretofore to make an electrical connection between a contact member associated with the strip or terminal and a conductor which is to be mechanically and electrically secured to the contact member at the terminal.

In early strips or terminal blocks of this type, a screw forming the contact member was tightened to clamp the conductor in place after the conductor had been placed under the head of the screw or between some other portion of the screw and a support. Such arrangements afforded highly effective mechanical locking in combination with a good electrical connection, but were difficult to manipulate and were time consuming to operate.

Solder-lug connections provide still better electrical junctions but often are mechanically insecure. In recent years efforts have been made to provide quick-operating connectors in which a stripped or unstripped end of the conductor is mechanically locked in place and during the locking operation is brought into forceable engagement with a cutting edge of the contact member so that the secured electrical connection is ensured by cutting into the conductor with the contact member.

While devices of this type are available in a variety of forms, this invention is concerned primarily with devices in which the movement of the conductor is effected by a swivel device which carries the conductor end into engagement with the contact element.

For example, in German patent document DE-OS No. 29 15 184, the swivel device forms part of a contact element made from a sheet metal strip and having the shape of a "U" lying on a side with an upper leg disposed above the lower leg. The upper leg carries the connecting wire and by pressing down the free leg, a cutting and clamping terminal projecting upwardly from the lower leg locks against the conductor and holds the free end of the upper leg in a locked position as well as to grip the conductor.

German patent document DE-OS No. 23 55 873 represents an earlier arrangement in which the wires to be connected are inserted into holes in a disk and are pressed into circularly disposed contact elements.

Still another arrangement provides an axially displaceable connector sleeve whose movement causes radially resilient terminals to press into corresponding chambers of a connector body, the conductors previously having been inserted into these chambers to make electrical contact.

These systems are only examples of the prior art techniques which have hitherto been used to lock a conductor mechanically, simultaneously with a cutting or like action to ensure electrical connection.

OBJECTS OF THE INVENTION

It is the principal object of the present invention to provide a connector or terminal utilizing mechanical action and which has an easily operated swivel device for the economical and reliable mechanical and electrical engagement of a conductor whereby disadvantages of earlier systems are obviated.

Another object of this invention is to provide an inexpensive reversible operable connector or terminal strip which enables securing mechanical and electrical engagement to be attained but yet permits the conductor to be disconnected readily and indeed, allows the mechanical actuating device to disconnect the conductor or the contact member as easily as the original connection was made.

SUMMARY OF THE INVENTION

These objects and others which will become apparent hereinafter are attained, in accordance with the present invention, in a connecting strip or terminal strip provided with at least one and preferably a row of swivel elements each of which is pivotal about an axis which can be a common axis for all of the elements of the row and is provided with a pivot portion proximal to the axis and a guide portion outwardly of the axis and provided with a passage aligned radially with an insertion hole of the pivot portion so that a conductor inserted through the guide passage can enter the insertion hole. Between the guide passage and the insertion hole, we provide a contact member with a keyhole window such that the conductor is inserted into the larger portion of this window and, upon rotation of the swivel member is carried by the two portions thereof relative to the contact member and into the narrow part of the window which acts as a cutting and clamping slot. According to the invention, the insertion hole, the guide passage and the slot are coplanar, i.e. lie in a common plane perpendicular to the swivel axis.

According to a feature of the invention, the contact member forms a bow around the pivot portion of the swivel member so that the latter is retained in or on a housing of the connector or terminal strip with the aid of the contact member or element.

More particularly, the contact member or element comprises a band or strip formed with the window and surrounding a circular pivot portion of the swivel member which can have a notch engageable by a detent of the band or strip to index the swivel member in a position in which its passage and its insertion hole are aligned with the large part of the window. The rotation of the swivel member cams the detent out of the notch or recess. The pivot portion thus constitutes a holding member which is retained by the contact member, strip or band on the housing.

The swivel member can be formed with a further portion constituting an actuating lever which can have a slot engageable by a screwdriver or the like which can function as an extension of the lever arm.

The axes of the guide passage, the large part of the window and the insertion hole when they are in alignment in the nonactuated state of the swivel member form an angle of less than 90° and greater than 30° with a base plate of the housing upon which the swivel member is mounted, the through hole and guide passage having a common axis lying parallel to the base plate in the actuated state of the device.

According to another feature of the invention, the base plate or housing is provided with a retainer or hold-down device into which the conductor is carried as it is forced into the cutting slot of the contact member in the rotary entrainment of the conductor by the swivel member.

The detent can also be provided to engage in a further notch or recess of the pivot portion so that the swivel member is capable of being arrested in two different locking position and, in addition, the swivel member can comprise a disk-shaped segment which is guided in a complementary slot in the housing.

According to yet another feature of the invention, the pivot member is formed with a slot which opens laterally to permit the contact strip or band to be inserted and it has been found to be advantageous to provide a second laterally open slot radially spaced from the first to accommodate a second contact band or strip similarly provided with a keyhole window to improve the electrical connection and to permit two different contacts to be simultaneously connected to a common conductor.

The contact member can be so provided that a free end of the tape or band provides a pin which in turn constitutes a plug which can be received in a jack, both ends of the band can have the same type of connection or different types of connections and at least one end can be soldered in a printed circuit board.

It has been found to be advantageous when one or more of the contact members has a plug pin, to surround each pin or all or some of the pins with a collar of the housing. The housing itself may be a single member provided with a number of swivel members and the respective contact members, or the housing may be assembled from a number of similar parts, each carrying a single swivel member.

The connecting strip of the invention has numerous advantages over prior art devices in that the swivel part without strenuous effort can be mounted on the housing readily, can receive a conductor which is inserted simply, and can be rotated with considerable ease to mechanically lock the conductor in the contact element and simultaneously effect electrical connection. Since the keyhole configuration of the window enables a narrow slot which is closed at its end to be used to cut into the conductor, comparatively narrow swivels and contact members can be provided to permit close spacing between the conductors and contact members.

Since the contact element simultaneously provides the holding device for the swivel, additional mounting members are avoided.

DESCRIPTION OF THE DRAWING

The above and other objects, features and advantages of the present invention will become more readily apparent from the following description, reference being made to the accompanying drawing in which.

SPECIFIC DESCRIPTION

Figure 1:
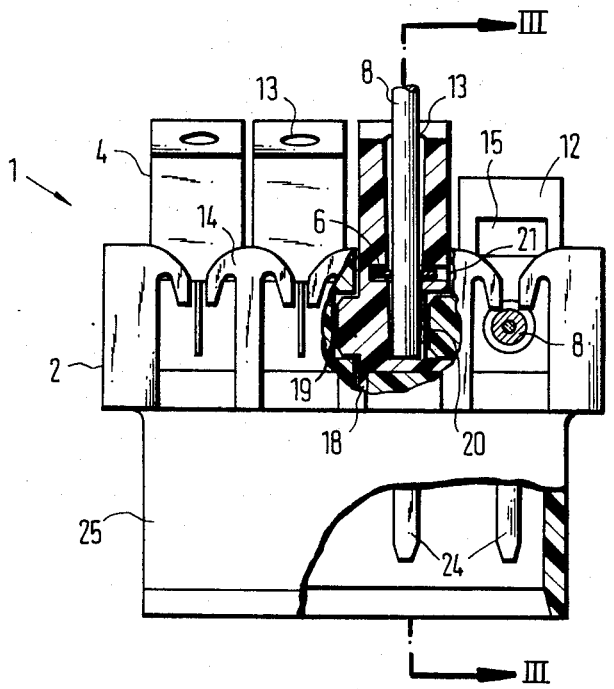
FIG. 1 is a front elevational view of a plug-type connecting strip showing a right-hand swivel member in its locked position with the conductor both mechanically and electrically engaged, its next swivel partly broken away and receiving a conductor before the swivel has been rotated into its locked position, and two other swivel members in their unactuated position, part of the collar having also been broken away.

In FIGS. 1 to 5, the connection strip unit is generally indicated by the reference numeral 1. This unit substantially consists of a housing 2 in which at least one contact element 3 and one swivel device consisting of a swivel part 4 are arranged.

Figure 3:
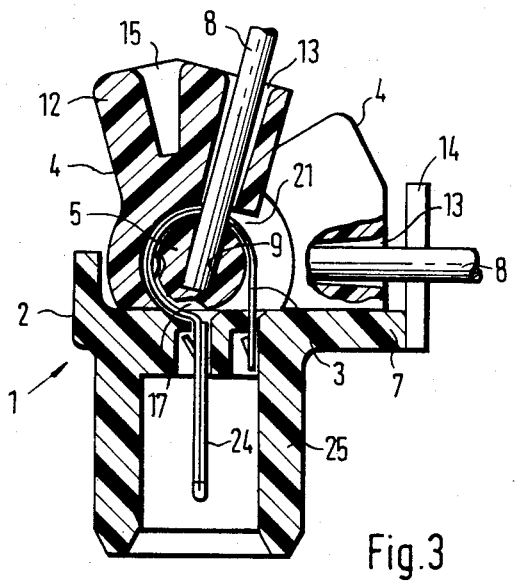
FIG. 3 is a transverse section taken along the line III—III of FIG. 1.
Figure 4:
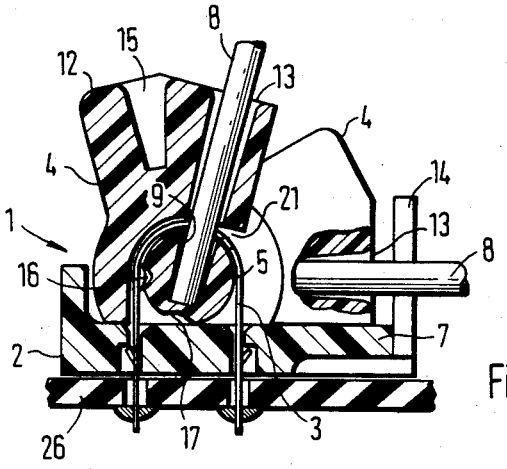
FIG. 4 is a view similar to FIG. 3 but showing another embodiment of the connector strip mounted on a printed circuit board.
Figure 5:
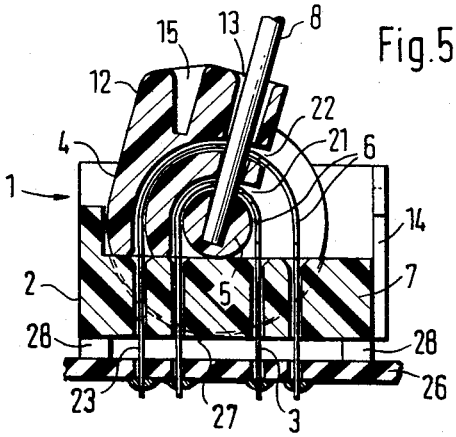
FIG. 5 is another view similar to FIG. 3 but of a connecting strip more closely resembling that of FIG. 4, utilizing two contact members per swivel.

As can be seen in particular from FIGS. 3 to 5, the swivel part 4 comprises a hold member or pivot portion 5 with the aid of which it is mounted inside the housing 2. As a mounting means there is used advantageously the contact element 3 itself. The latter is provided with a tape-shaped section 6 which partly surrounds the hold member 5, and with the tape ends thereof being secured in or to the base plate 7 of the housing 2.

The hold member 5 is designed as a pivot whose longitudinal axis represents the axis of rotation of the swivel device. Transversely in relation to the axis of rotation, the pivot is provided with at least one insertion hole 9 for guiding a wire 8 to be connected, with this insertion hole 9 lying in one plane with the cutting and clamping slot 10 contained in the circular curved portion of the contact element 3. The cutting and clamping slot 10 is not only closed at its lower end, but also at its upper end, i.e. the large part 11 of the window.

At the beginning of the cutting and clamping slot 10, therefore, there is arranged a throughhole 11 of this window (FIG. 2) which is in alignment with the insertion hole 9 of the pivot when the swivel part 4 is in its non-actuated state. Appropriately, also in that portion of the swivel part 4 acting as the actuating lever 12, there is provided a wire guide 13 which is in alignment with the throughhole 11 in the contact element and with the insertion hole 9 in the hold member 5. This wire guide, as can be seen from the examples of embodiment of the connection strip unit 1 as shown in FIGS. 3 to 5, is designed as a conical through bore. The function of the wire guide 13, however, can also be performed by a groove provided for on the bottom side of the actuating lever 12.

The axes of the wire guide 13, of the throughhole 11 and of the insertion hole 9 which are in alignment with one another and, in the non-actuated state of the swivel part 4, form an angle of less than 90° and greater than 30° together with the base plate 7 of the housing 2. For establishing a connection with the contact element 3 of the connection strip 1, the wire 8 is inserted slantingly into the swivel part 4, to such an extend that the end thereof meets against the bottom of the insertion hole 9, designed as a blind hole, in the pivot. Upon pressing down the actuating lever 12, the wire 8 is pressed into the cutting and clamping slot 10 and, outside the swivel part 4, for effecting a strain-relieved holding, simultaneously also between the spring tongues of mushroom-shaped holding-down devices 14 of the housing 2. The pressing down of the actuating lever 12 can be easily carried out manually, but this can also be done with the aid of a screwdriver whose pointed end is then inserted into a recess 15 arranged above the opening of the wire guide 13.

In an advantageous manner, the swivel part 4 has two angularly offset operative positions. A first lock-in position retains it in the non-actuated, open position while the second lock-in position prevents the actuated swivel part or the wire 8 as clamped therein, from becoming loose on its own. The lock-in positions, as is shown in particular in FIGS. 3 and 4, are formed by a locking arm or detent 16 embossed in the tape-shaped section 6 of the contact element 3, and by two fitting locking notches 17 provided for in the pivot portion of the swivel part 4. They can also be realized, however, with the aid of corresponding arrangements acting, for example, between the swivel part 4 and the housing 2.

In order to prevent the possible tilting of the swivel part while connecting a wire 8, the swivel part 4 is provided with a disk-shaped segment 18 which is guided in a complementary slot in the housing 2. In cases where several swivel parts 4 are lined up within one housing 2, it is also possible to provide for a further guide by which the forces appearing during the actuation of one swivel part 4, are distributed to neighboring swivel parts. This additional guide consists of a pivot 19 projecting on one side of the swivel part 4, which respectively engages into the cavity 20 as correspondingly arranged on the other side, of a neighboring swivel part 4 (FIG. 1). In that case, the side walls of the housing 2 are identically designed on the insides.

Figure 2:
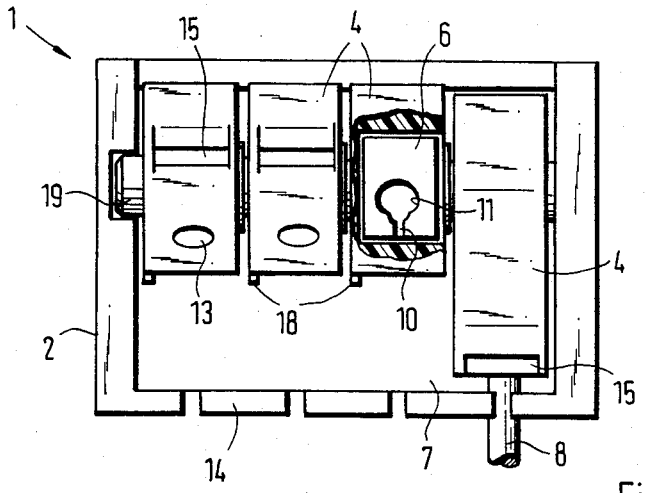
FIG. 2 is a plan view of this connector, also partly broken away.

As shown in FIGS. 1 and 2, the band shaped section 6 of the contact element 3 is smaller than the swivel part 4 and completely recessed in the slit 21 provided in the hold part 5 and opening at one side of the swivel member 4.

As can be seen from the embodiment of FIG. 5, at a uniform spacing from the slit 21, a further slit 22 can be provided to receive a second contact element 23, thereby providing the advantage of two independent wire contacts or connections.

The extended ends of the band shaped contact element portions 6 secured in the base plate 7 can have shapes depending upon the use to which the contact strip is to be put. According to FIGS. 1–3, the slender end of the contact, doubled back on itself, forms a plug contact or pin 24 which can be received in a jack complementary to the plug side of the contract strip. These terminals can also be posts to which wires can be attached by twirling them around the post. They can also form lugs to which solder connections can be made, either by solder lugs or direct soldering of wire thereto. Naturally, combinations of these approaches can also be used and, for instance, one end of the strip 6 forming the contact may form a plug connector pin while the other end forms a solder lug or another plug connector pin. In FIGS. 4 and 5, for example, both ends of the contact strips have similar connections, i.e. are inserted through holes of a printed circuit board and are soldered to the circuitry. Thus it will be seen that the terminals on both ends of the strip can be the same or different.

In the embodiment in which the terminals are plug pins 24, they all may be surrounded by a common collar 25 (FIG. 1) which can receive the jack into which these pins fit. In general, the housing will have a substantially box-shaped form. The ends of the contact elements 3, 23 are mounted therein, for example, either by employing the ultrasonic welding process, or nonpositively, for example, with the aid of a snap-action joint, or detachably by way of twisting. As is shown in FIGS. 4 and 5, the prolonged mounting ends of the contact elements 3,23 form connecting lugs for being soldered into printed circuit boards 26.

The housing 2 of the connection strip unit 1 and the swivel parts 4 thereof each consist of bodies of insulating material injection-moulded in one piece. While in the examples of embodiment described hereinbefore with reference to the drawings, several lined-up swivel parts 4 are arranged inside one housing 2, the housing in a not shown example consists of individual sections capable of being lined up and joined together with the aid of e.g. a dovetail guide or with the aid of snap fasteners, which each contain one swivel part 4 with at least one contact element 3.

Independently of whether the housing 2 of the connection strip unit 1 is made of one piece or consists of individual sections joined together, it is provided on the bottom side 27 of its baseplate 7 appropriately with a circumferential strip or with several spacers 28, permitting the housing to be mounted on printed circuit boards 26.

We claim:

1. A connector comprising:

a housing;

at least one swivel member journaled on said housing and rotatable about a pivot axis, said swivel member having an insertion hole adapted to receive an electrical conductor; and a contact member provided with a cutting and clamping slot lying in a common plane with said hole, said plane being perpendicular to said axis, whereby rotation of said swivel member upon insertion of a conductor into said hole entrains said conductor into said slot to mechanically lock said conductor to said contact member and effect electrical connection between said conductor and said contact member, said swivel member being retained on said housing by said contact member.

2. A connector comprising:

a housing;

at least one swivel member journaled on said housing and rotatable about a pivot axis, said swivel member having an insertion hole adapted to receive an electrical conductor; and a contact member provided with a cutting and clamping slot lying in a common plane with said hole, said plane being perpendicular to said axis, whereby rotation of said swivel member upon insertion of a conductor into said hole entrains said conductor into said slot to mechanically lock said conductor to said contact member and effect electrical connection between said conductor and said contact member, said swivel member being retained on said housing by said contact member, said swivel member having a substantially circular pivot portion and said contact member being a band extending around said pivot portion.

3. The connector defined in claim 2 wherein said band is provided with a keyhole window provided with a large opening extending into said slot, said large opening being radially aligned with said insertion hole in a nonactuated position of said swivel.

4. The connector defined in claim 3 wherein said swivel is provided with an actuating lever radially outwardly of said pivot portion and provided with a guide passage radially aligned with said hole and disposed outwardly of said band.

5. The connector defined in claim 4 wherein the axis of said passage and said hole and the axis of said large opening are aligned in a nonactuated state of the swivel member and form an angle of less than 90° and more than 30° with a base plate of said housing.

6. The connector defined in claim 4 wherein said lever is provided with a recess for receiving the blade of a screwdriver facilitating the actuation of said swivel member.

7. The connector defined in claim 4 wherein said housing is formed with at least one hold-down device spaced from said axis and engageable with said conductor upon rotation of said swivel member to displace said conductor into said slot.

8. The connector defined in claim 4 wherein said pivot portion is formed with a disc-shaped segment guided in a complementary slot formed in said housing.

9. The connector defined in claim 4 wherein the ends of said bands are provided with different types of connections.

10. The connector defined in claim 4 wherein a plurality of such swivel members with respective contact members are provided in a row in a common one-piece housing.

11. The connector defined in claim 4 wherein each of a number of said swivel members is provided with a respective housing part connected to an adjoining housing part whereby said swivel members are disposed in a row.

12. The connector defined in claim 4, further comprising detent means for releasably retaining said swivel member in one of two selected angular positions.

13. The connector defined in claim 12 wherein said detent means include a detent form on said pair and a pair of notches formed in said pivot portion and engageable by said detent.

14. The connector defined in claim 4 wherein said pivot portion is defined by an arcuate slot extending laterally into said swivel member and laterally receiving said band.

15. The connector defined in claim 14 wherein said swivel member is provided with a further arcuate slot, coaxial with the first mentioned slot and receiving another band provided with a keyhole opening transverse by said conductor upon insertion of said conductor through said passage into said hole.

16. The connector defined in claim 4 wherein said band has both of its ends having the same type of connection.

17. The connector defined in claim 16 wherein said housing is mounted on a printed circuit board and said connections are solder connections to said printed circuit board.

18. The connector defined in claim 4 wherein said band has one end projecting from said housing as a plug pin terminal.

19. The connector defined in claim 18, further comprising a collar surrounding said terminal.

20. A connector comprising:

a housing;

at least one swivel member journaled on said housing and rotatable about a pivot axis, said swivel member having an insertion hole adapted to receive an electrical conductor; and a contact member provided with a cutting and clamping slot lying in a common plane with said hole, said plane being perpendicular to said axis, whereby rotation of said swivel member upon insertion of a conductor into said hole entrains said conductor into said slot to mechanically lock said conductor to said contact member and effect electrical connection between said conductor and said contact member, said swivel member being retained on said housing by said contact member, said swivel member having a substantially circular pivot portion and said contact member being a band extending around said pivot portion, said swivel being provided with an actuating lever radially outwardly of said pivot portion and provided with a guide passage radially aligned with said hole and disposed outwardly of said band.

* * * * *